US006809276B1

(12) United States Patent
Guzman

(10) Patent No.: US 6,809,276 B1
(45) Date of Patent: Oct. 26, 2004

(54) INERTIALLY ACTIVATED SWITCH

(75) Inventor: Rudy Guzman, Coral Springs, FL (US)

(73) Assignee: BBC International, Ltd., Boca Raton, FL (US)

( * ) Notice: Subject to any disclaimer, the term of this patent is extended or adjusted under 35 U.S.C. 154(b) by 0 days.

(21) Appl. No.: 10/730,303

(22) Filed: Dec. 8, 2003

(51) Int. Cl.[7] ..... H01H 35/14
(52) U.S. Cl. ..... 200/61.48; 200/61.51
(58) Field of Search ..... 36/137; 200/61.45 R, 200/61.48, 61.49, 61.5, 61.52, 61.51; 362/103, 200, 201, 251, 276, 800, 802

(56) References Cited

U.S. PATENT DOCUMENTS

| | | | | |
|---|---|---|---|---|
| 2,547,199 A | | 4/1951 | Dezzani | 200/52 |
| 3,835,273 A | * | 9/1974 | Stolarik | 200/61.48 |
| 4,359,722 A | | 11/1982 | Valdez et al. | 340/540 |
| 4,412,205 A | | 10/1983 | Von Kemenczky | 340/331 |
| 5,285,031 A | * | 2/1994 | Schueneman | 200/61.48 |
| 5,371,662 A | * | 12/1994 | Shen-Ko | 362/276 |
| 5,450,049 A | | 9/1995 | Bachmann | 335/205 |
| 5,465,197 A | * | 11/1995 | Chien | 362/202 |
| 5,532,672 A | * | 7/1996 | Plazarin | 340/440 |
| 5,599,088 A | * | 2/1997 | Chien | 362/103 |
| 5,644,858 A | * | 7/1997 | Bemis | 36/137 |
| 5,794,761 A | | 8/1998 | Renaud et al. | 200/181 |
| 5,866,987 A | * | 2/1999 | Wut | 315/119 |
| 6,018,130 A | | 1/2000 | Haack et al. | 200/61.52 |
| 6,286,975 B1 | * | 9/2001 | Rodgers | 362/103 |

FOREIGN PATENT DOCUMENTS

| | | | |
|---|---|---|---|
| JP | 08-320250 | 3/1996 | G01H/1/00 |

* cited by examiner

*Primary Examiner*—Michael A. Friedhofer
(74) *Attorney, Agent, or Firm*—Holland & Knight LLP

(57) ABSTRACT

A switch according to this invention is particularly intended for use with articles of footwear as part of a light module which also includes one or more batteries, an integrated circuit and wire connections to LEDs or other sources of light mounted to the outsole or upper of the article of footwear. The switch is formed with a housing having a hollow interior within which a pair of spaced contacts are mounted, at least one of which is connected to the battery. A cover plate is mounted to the housing such that an electrically conductive pivot arm carried by the cover plate is positioned between the spaced contacts. In response to the application of an inertial force to the switch, the pivot arm is movable in the manner of a pendulum into engagement with either one or both of the contacts thus completing the circuit between the battery and integrated circuit allowing it to activate the LEDs.

26 Claims, 4 Drawing Sheets

INERTIALLY ACTIVATED SWITCH

FIELD OF THE INVENTION

This invention relates to switches, and, more particularly, to a switch having a pendulum or pivot arm movable in response to the application of motion or an inertial force between an open position and a closed position.

BACKGROUND OF THE INVENTION

Historically, the decorative features of many articles of footwear have involved the use of different accents on the upper or outsole of the shoe such as colors, stripes, cartoon or other characters and other decorations. More recently, and particularly in children's footwear, the outsole and/or upper of shoes have been decorated with an array of light sources, usually light emitting diodes or LEDs.

In many designs of shoes employing LEDs or other light sources, a light module is mounted in the outsole of the shoe which is connected by wires to LEDs positioned in various locations on the outsole and/or upper of the shoe. As used herein, the term "light module" refers to a self-contained unit consisting of a housing which mounts an electrical circuit including one or more batteries, an integrated circuit (IC) or chip and a switch. The LEDs, in turn, are electrically connected to the IC. Depending on the type of switch employed in the circuit, in response to the application of motion, pressure, an inertial force or some other stimulus to the shoe, the switch is operable to activate the IC, which, in turn, causes the LEDs to turn on and off.

A number of different switches for use in light modules of the type described above have been proposed. The design parameters are quite demanding in that the switch must be small, contain no harmful substances, operate with little or no noise and demonstrate acceptable reliability considering that they are typically activated with nearly every step one takes while the shoe is worn. Mercury switches have been tried, but are not acceptable particularly in shoes for children due to the potential leakage of harmful mercury from the switch. Other switches employ a movable ball to turn on and off, but these have been found to be too noisy and unreliable.

Another switch design in the prior art is a "spring" switch such as disclosed, for example, in U.S. Pat. Nos. RE 37,220; 6,525,487; 6,286,975; 6,012,822; 5,969,479; 5,894,201 and 5,812,063. Switches of this type typically include a spring element having one end fixed, and a free end movable with respect to a contact. In response to motion or the application of an inertial force to the light module, such as by movement of the shoe, the free end of the spring element moves from a neutral or open position to a closed position in engagement with the contact. Closing of the switch completes the electrical circuit thus connecting the battery of the light module to the IC allowing it to operate and cause the LEDs to illuminate.

A number of prior patents directed to switches employ the concept of a swinging pendulum operative to open and close the switch. For example, U.S. Pat. No. 6,018,130 teaches a sensor having a permanent magnet located in proximity to a reed switch. A shunt or pendulum swings between a position in which it is located between the magnet and reed switch to block the magnetic field produced by the magnet allowing the reed switch to open. When the shunt moves out of alignment with the magnet and reed switch, the magnetic field produced by the magnet causes the reed switch to close. U.S. Pat. No. 5,450,049 describes a variation of a reed switch-magnet construction, similar to the '130 Patent design, except that the magnet itself is movable in a swinging or pendulum motion relative to the reed switch.

U.S. Pat. No. 5,794,761 discloses a swinging element consisting of a plate and an elastic rod which are movable between a pair of electrodes located at each end of the range of travel of the swinging element. A control unit adjusts the electrostatic attraction applied to the plate by each electrode so that the switching time of the swinging element is determined primarily by its natural frequency.

U.S. Pat. No. 5,371,662 teaches a pendulum-type switch in the environment of an article of footwear comprising a casing which mounts a first metal contact carried by a conductive block, a second metal contact located along the base of the casing and a swivel device pivotally mounted to the conductive block by a pin. The swivel device includes a pivot arm mounted at one end to the pin and at the opposite end to a counter weight. One lead from a battery connects to the contact, a second lead from the battery connects to a light and the light is also connected by a lead to the second contact. The counter weight is normally held in a neutral position by a torsion spring, but in response to the application of an inertial force the swivel device pivots allowing the counter weight to engage the second contact thus completing the electric circuit and turning on the light.

SUMMARY OF THE INVENTION

The switch of this invention is particularly intended for use with articles of footwear as part of a light module including one or more batteries or other sources of power, an IC and wire connections to LEDs or other sources of light. The switch includes a housing having a hollow interior within which a pair of spaced contacts are mounted, at least one of which is connected to the battery. A cover plate is mounted to the housing such that an electrically conductive pivot arm carried by the cover plate is positioned between the spaced contacts. In response to the application of an inertial force to the switch, the pivot arm is movable in the manner of a pendulum into engagement with either one or both of the contacts thus completing the circuit between the battery and IC allowing it to activate the LEDs.

In one presently preferred embodiment, the two contacts are spanned by an electrically conductive plate and one of the contacts is connected to a terminal of the battery. The pivot arm is mounted by a rod, carried by a pair of spaced side plates mounted to the cover plate, in a position to swing between the spaced contacts. A coil spring extends between one of the side plates and the pivot arm which is effective to maintain the pivot arm in a neutral position out of engagement with both of the contacts. In response to the application of motion or an inertial force to the switch, the spring force of the coil spring is overcome allowing the pivot arm to engage one of the contacts. Because a contact is located on either side of the pivot arm, movement of the shoe in essentially any direction causes the IC to be activated resulting in illumination of the LEDs.

In an alternative embodiment, the coil spring is eliminated and the pivot arm is allowed to engage one of the contacts when the shoe is at rest. The IC in this version of the invention is provided with a timer which interrupts the connection between the battery and LEDs after a predetermined period regardless of the position of the pivot arm. Otherwise, the LEDs would be continuously illuminated and the battery would quickly drain. In response to the application of motion or inertial force to the switch of this embodiment, the pivot arm is movable into engagement with the other contact thus effectively resetting the timer of the IC and allowing it to operate the LEDs.

DESCRIPTION OF THE DRAWING

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
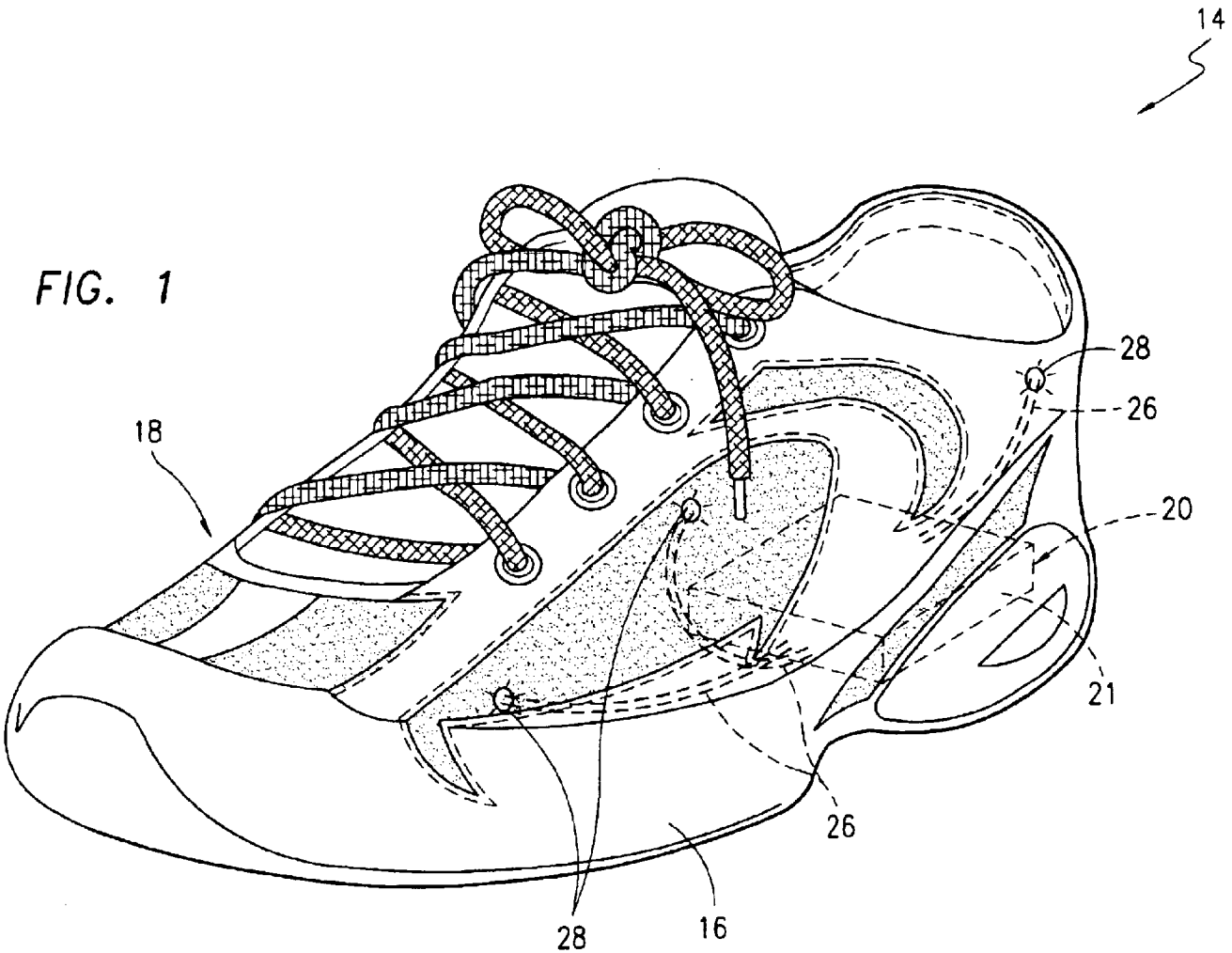
FIG. 1 is schematic, perspective view of a shoe which incorporates the switch of this invention within a module mounted in the heel area of a shoe connected to an array of LEDs on the shoe upper.
Figure 2:
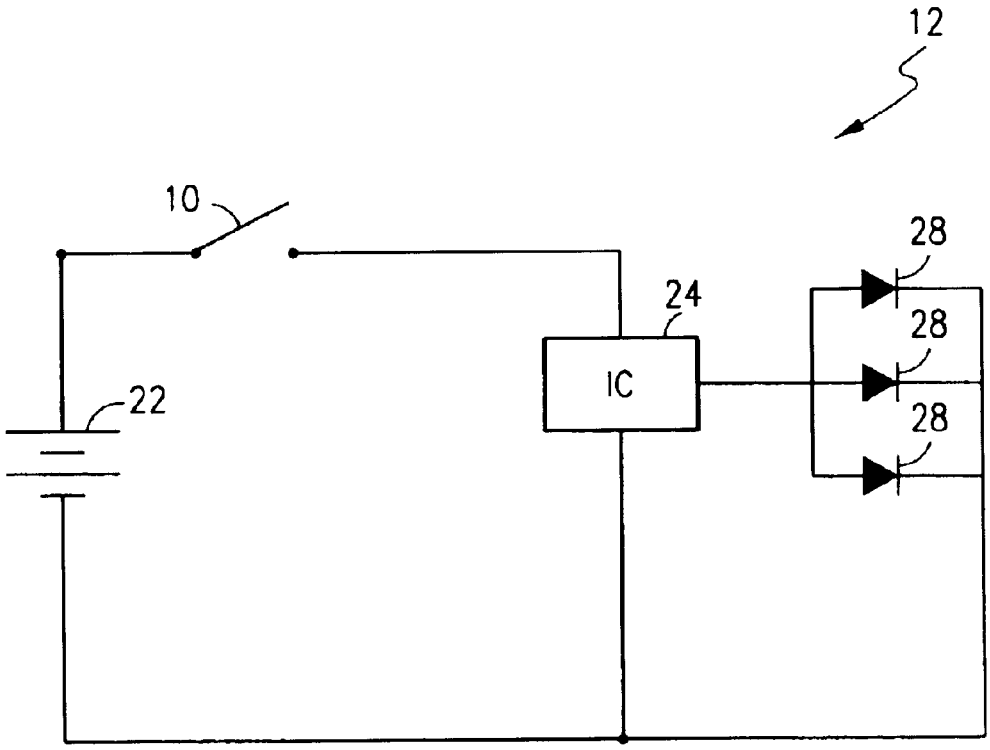
FIG. 2 is a schematic view of one embodiment of an electrical circuit for the shoe of FIG. 1 employing the switch herein.

Referring now to FIGS. 1 and 2, the switch 10 of this invention is schematically shown as part of an electrical circuit 12 mounted to an article of footwear such as a shoe 14. The shoe 14 conventionally includes an outsole 16 connected to an upper 18. A light module 20 is preferably mounted to the outsole 16 in the heel area of the shoe 14, preferably within a cavity formed in the outsole 16 which is covered by the insole (not shown) of the shoe. The light module 20 includes a plastic casing 21 which carries components of the electrical circuit 12 including a battery 22, an integrated circuit or IC 24 and the switch 10. The IC 24, in turn, is connected by wires 26 to an array of LEDs 28 mounted to the upper 18 of the shoe 14.

The detailed construction and operation of the electrical circuit 12 forms no part of this invention, except for the switch 10 as described below. For purposes of the present discussion, in response to movement of the switch 10 to a closed position, the IC 24 is electrically connected to battery 22. When activated, the IC 24 operates to illuminate the LEDs 28 in a selected flashing or other sequence, and then to turn off the LEDs 28. Integrated circuits capable of operating LEDs in a flashing sequence are well known in the art, and one integrated circuit suitable for use as IC 24 is commercially available under part no. 6608 from Cheerine Development (Hong Kong) Ltd., a corporation having a place of business at Room 1217, North Tower, Concordia Plaza, No. 1 Science Museum Road, Tsim Sha Tsui East, Kowloon, Hong Kong.

Figure 3:
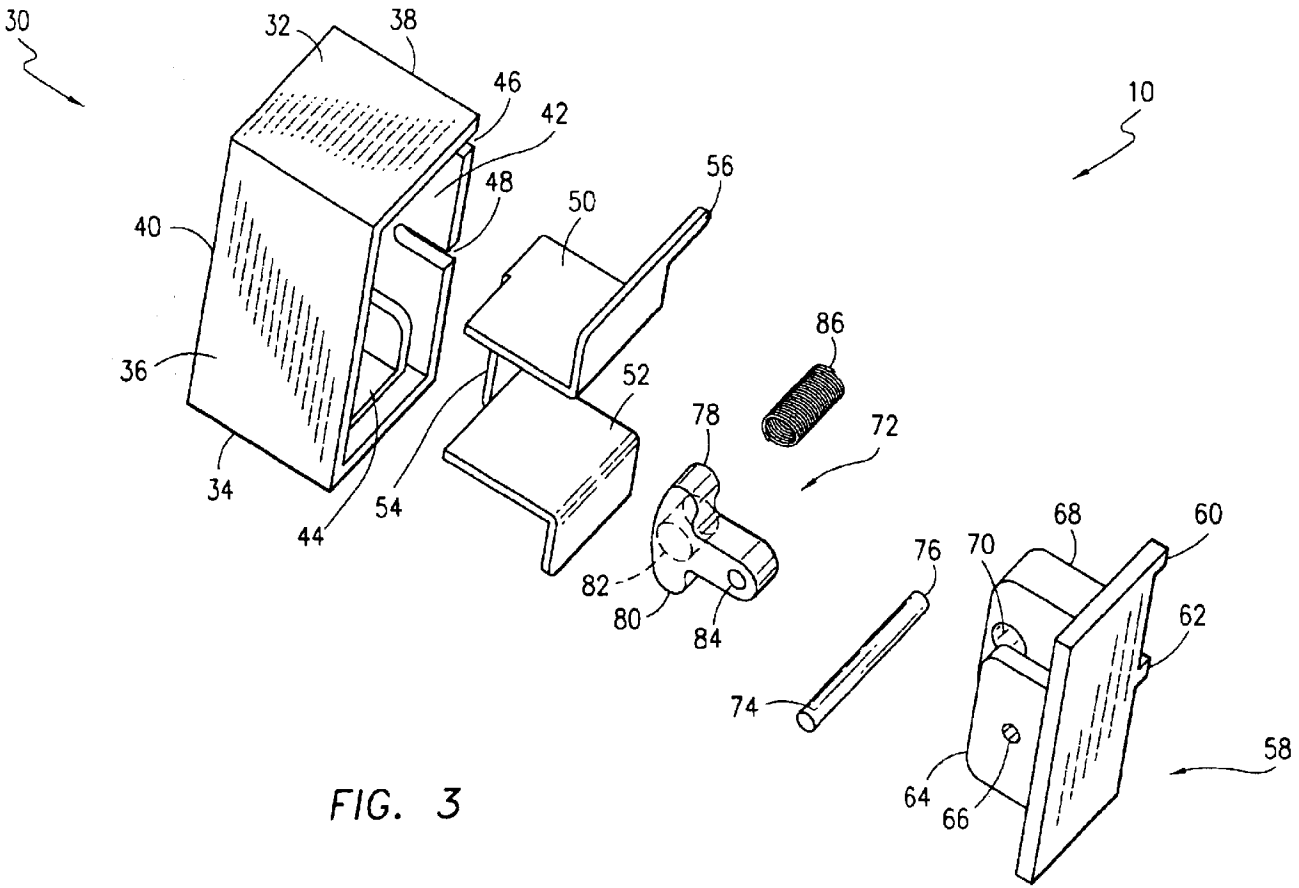
FIG. 3 is an exploded, perspective view of one embodiment of the switch of this invention.
Figure 4:
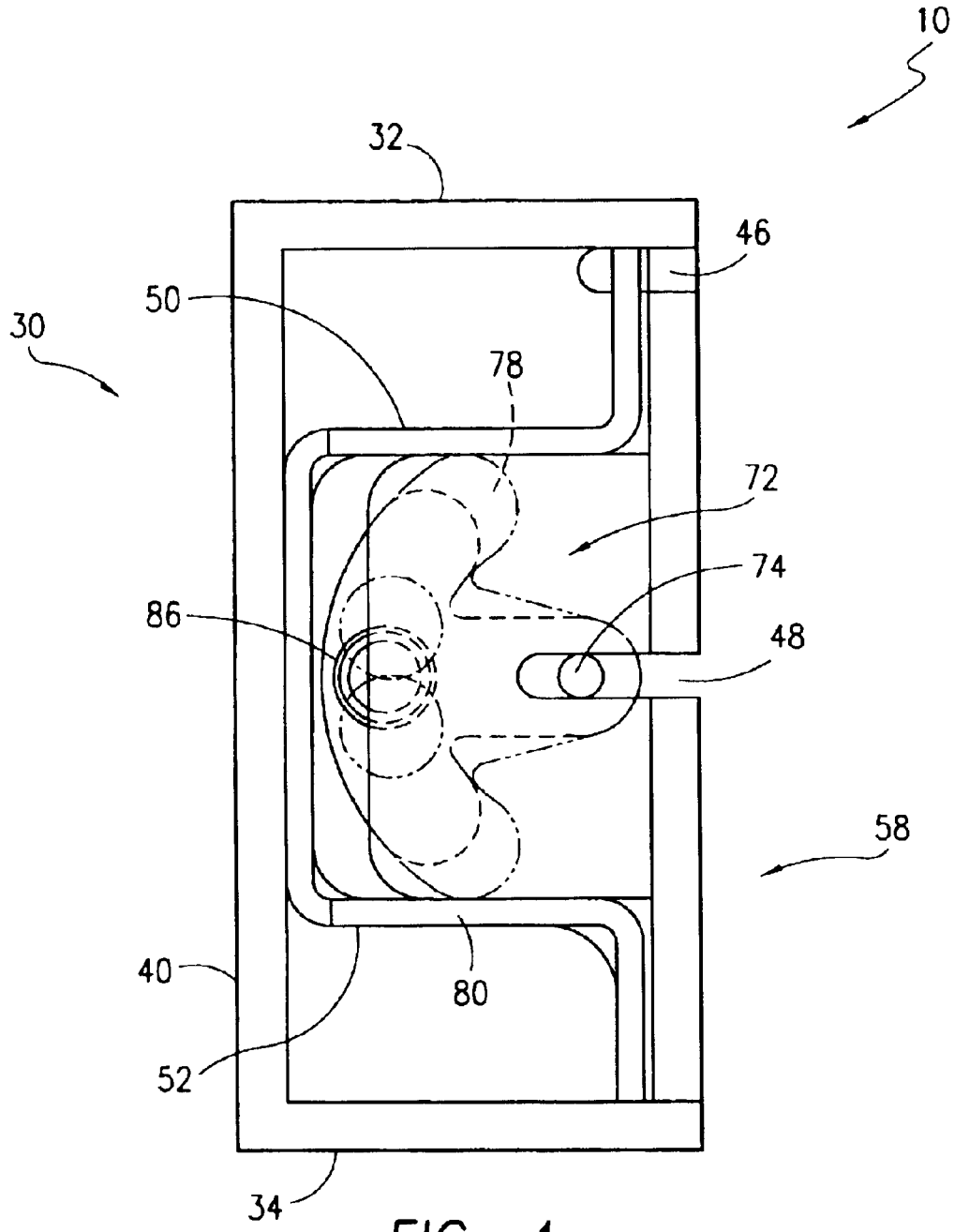
FIG. 4 is a side view of the switch of FIG. 3, as assembled.

Referring now to FIGS. 3 and 4, details of the switch 10 of this invention are shown. The switch 10 comprises a housing 30 having a top wall 32, bottom wall 34, opposed side walls 36, 38 and a back wall 40 interconnected to form a hollow interior 42 which is open at the front. The terms "top," "upper," "bottom," "lower," "back" and "front" as used herein refer to the orientation of the switch 10 as depicted in FIGS. 3 and 4. A seat 44 is mounted within the interior 42 of housing 30, and it extends along the bottom wall 34 and part way along the side wall 38. The side wall 38 is formed with an upper slot 46 near the top wall 32, and a lower slot 48 approximately midway along the height of the side wall 38.

The housing 30 mounts an upper contact 50 and a lower contact 52 which are electrically connected by a plate 54. The upper and lower contacts 50, 52 are both formed in the general shape of an "L", with the upper contact 50 having an outwardly extending terminal 56. The upper and lower contacts 50, 52 slide into the interior 42 of the housing 30 such that the lower contact 52 rests atop the seat 44 and the terminal 56 of the upper contact 50 is received within the upper slot 46 in the side wall 38.

The remainder of the switch 10 forming a closure for the housing 30 is depicted on the right-hand portion of FIG. 3. Such closure includes a cover plate 58 which is formed with an upper tab 60 and a lower tab 62 both projecting from a side edge of the cover plate 58. A first side plate 64 having a through bore 66 is mounted to one face of the cover plate 58, and a second side plate 68 is mounted to the cover plate 58 spaced from the side plate 64. The side plate 68 is formed with a through bore (not shown) which aligns with the through bore 66 in side plate 64, and a recess 70 extending part way through the thickness thereof.

A pivot arm 72 is pivotally mounted between the side plates 64, 68 by a rod 74 which is received within the through bore 66 of side plate 64 and the aligning through bore in the side plate 68. One end of the rod 74 protrudes from the side plate 68 forming a terminal 76. The pivot arm 72 has an upper node 78 spaced from a lower node 80, a recess 82 formed part way therein and a through bore 84 which receives the rod 74. In one presently preferred embodiment, when the pivot arm 72 is mounted between the side plates 64, 68, a coil spring 86 extends between the recess 70 in the side plate 68 and the recess 82 in the pivot arm 72, for purposes to become apparent below. Alternatively, the spring 86 can be eliminated such that the pivot arm 72 is supported only by the rod 74 between the side plates 64, 68.

The "closure" consisting of the cover plate 58, side plates 64, 68, pivot arm 72 and rod 74 is received within the interior 42 of the housing 30 such that the upper and lower nodes 78 and 80 of the pivot arm 72 are located between the upper and lower contacts 50 and 52. The upper and lower tabs 60, 62 on the side edge of the side plate 68 snap fit into the upper and lower slots 46, 48 of the side wall 38 of housing 30, respectively, to secure the closure to the housing 30, and the terminal 76 formed at one end of the rod 74 protrudes from the lower slot 48 in the side wall 38 for connection to the electrical circuit 12.

The switch 10 of this invention operates as follows. In the embodiment shown in FIGS. 3 and 4 wherein the coil spring 86 is connected between the pivot arm 72 and the side plate 68, the pivot arm 72 is maintained in a "neutral" position by the coil spring 86, i.e. out of engagement with either the upper or lower contact 50, 52. In response to the application of motion or an inertial force to the switch. 10, the pivot arm 72 overcomes the spring force of the coil spring 86 and is pivotal about rod 74 in a swinging or pendulum-type motion so that the upper and lower nodes 78, 80 of the pivot arm 72 can engage one of the upper and lower contacts 50, 52, respectively. Upon engagement of the pivot arm 72 with either one of the contacts 50, 52, the battery 22 is connected to the IC 24 and the LEDs 28 are illuminated, as discussed above.

In the embodiment of the switch 10 employing the coil spring 86, the IC 24 is operative to illuminate the LEDs 28 in a particular lighting sequence, turn the LEDs 28 off and then reset in preparation for another lighting sequence when the pivot arm 74 engages the contacts 50 or 52 again. A modified IC 24 is used in the embodiment of this invention wherein the coil spring 86 is eliminated. In that embodiment, one of the upper or lower nodes 78, 80 of the pivot arm 72 engages a contact 50 or 52 continuously, i.e., the switch 10 is normally in the "closed" position. Upon the application of motion or an inertial force to the switch 10, the pivot arm 74 moves into engagement with the contact 50, 52 opposite the one it has been resting upon to initiate operation of the IC 24. Once a lighting sequence has been completed, the IC 24 is effective to turn off the LEDs 28 and disconnect from the battery 22 even though the switch 10 is essentially continuously closed. This is preferably accomplished by the inclusion of a timing circuit in the IC 24 which disconnects the LEDs from the battery 22 after a predetermined period of time, regardless of the position of the switch 10, and then resets in preparation for another lighting sequence initiated by the switch 10. Timing circuits for this purpose are well known in the art, form no part of this invention and are therefore not described herein. See, for example, U.S. Pat. Nos. 4,848,009 and 6,280,045.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, the switch of this invention has been described as particularly intended for use in an article of footwear as part of a "light module." It is contemplated that the switch can be employed in a module which produces sound, or a combination of sound and light, in which an IC is provided which is connected to a loudspeaker instead of or in addition to an LED or other light source. Further, the module which produces light and/or sound need not be mounted to a shoe but can be affixed to a hat, jacket, shirt or other article of clothing. Additionally, the term "upper" as used herein is intended to be broadly construed to include that portion of any article of footwear mounted or connected to an outsole, such as the straps of a sandal.

Therefore, it is intended that the invention not be limited to the particular embodiment disclosed as the best mode contemplated for carrying out this invention, but that the invention will include all embodiments falling within the scope of the appended claims.

I claim:

1. A switch, comprising:

a housing having a hollow interior;

a first contact spaced from a second contact, said first and second contacts being located within said hollow interior of said housing;

a closure mounted to said housing, said closure including a pivot arm having first and second nodes located between said first and second contacts, said pivot arm being movable in response to the application of an inertial force in a first direction wherein said first node engages said first contact or in a second direction wherein said second node engages said second contact.

2. The switch of claim 1 in which said first contact is connected to said second contact by an electrically conductive plate.

3. The switch of claim 1 in which one of said first and second contacts is adapted to be electrically connected to the terminal of a battery.

4. The switch of claim 1 in which said closure includes a cover plate, a pair of spaced side plates connected to said cover plate and a rod extending between said side plates.

5. The switch of claim 4 in which said pivot arm is pivotally mounted to said rod.

6. The switch of claim 5 further including a spring connected between said pivot arm and one of said side plates, said spring being effective to orient said pivot arm in a neutral position within said housing wherein said first and second nodes of said pivot arm do not engage either of said first and second contacts.

7. The switch of claim 1 in which one of said first and second nodes of said pivot arm is in continuous engagement with a respective one of said first and second contacts except upon the application of motion or an inertial force thereto.

8. A switch, comprising:

a housing having a hollow interior;

a first contact spaced from a second contact, said first and second contacts being located within said hollow interior of said housing;

a closure mounted to said housing, said closure including:

(i) a cover plate;

(ii) a pair of spaced side plates connected to said cover plate;

(iii) a rod extending between said side plates;

(iv) a pivot arm having spaced first and second nodes which are located between said first and second contacts, said pivot arm being pivotally mounted to said rod;

said pivot arm being movable in response to the application of motion or an inertial force in a first direction wherein said first node engages said first contact or in a second direction wherein said second node engages said second contact.

9. The switch of claim 8 in which said first contact is connected to said second contact by an electrically conductive plate.

10. The switch of claim 8 in which one of said first and second contacts is adapted to be electrically connected to the terminal of a battery.

11. The switch of claim 8 further including a spring connected between said pivot arm and one of said side plates, said spring being effective to orient said pivot arm in a neutral position within said housing wherein said first and second nodes of said pivot arm do not engage either of said first and second contacts.

12. The switch of claim 8 in which one of said first and second nodes of said pivot arm is in continuous engagement with a respective one of said first and second contact except upon the application of motion or an inertial force thereto.

13. An article of footwear, comprising:

an outsole connected to an upper;

an electrical circuit including a source of power, at least one light source and a switch, said electrical circuit being mounted to at least one of said outsole and said upper;

said switch being effective to trigger operation of said electrical circuit in response to the application of motion or an inertial force thereto to cause said at least one light source to illuminate, said switch including:

(i) a housing having a hollow interior;

(ii) a first contact spaced from a second contact, said first and second contacts being located within said hollow interior of said housing;

(iii) a closure mounted to said housing, said closure including a pivot arm having first and second nodes located between said first and second contacts, said pivot arm being moveable in response to the application of said inertial force in a first direction wherein said first node engages said first contact or in a second direction wherein said second node engages said second contact.

14. The article of footwear of claim 13 in which said first contact is connected to said second contact by an electrically conductive plate.

15. The article of footwear of claim 13 in which one of said first and second contacts is adapted to be electrically connected to the terminal of a battery.

16. The article of footwear of claim 13 in which said closure includes a cover plate, a pair of spaced side plates connected to said cover plate and a rod extending between said side plates.

17. The article of footwear of claim 16 in which said pivot arm is pivotally mounted to said rod.

18. The article of footwear of claim 17 further including a spring connected between said pivot arm and one of said side plates, said spring being effective to orient said pivot arm in a neutral position within said housing wherein said first and second nodes of said pivot arm do not engage either of said first and second contacts.

19. The article of footwear of claim 13 in which one of said first and second nodes of said pivot arm is in continuous engagement with a respective one of said first and second contact except upon the application of motion or an inertial force thereto.

20. A light module for use in an article of footwear, comprising:

a casing which mounts an electrical circuit including a source of power and a switch which are adapted to connect to at least one light source;

said switch being effective to trigger operation of said electrical circuit in response to the application of motion or an inertial force thereto to cause said at least one light source to illuminate, said switch including:

(i) a housing having a hollow interior;

(ii) a first contact spaced from a second contact, said first and second contacts being located within said hollow interior of said housing;

(iii) a closure mounted to said housing, said closure including a pivot arm having first and second nodes located between said first and second contacts, said pivot arm being moveable in response to the application of said inertial force in a first direction wherein said first node engages said first contact or in a second direction wherein said second node engages said second contact.

21. The light module of claim 20 in which said pivot arm of said switch device is electrically connected to said source of power.

22. The light module of claim 20 in which said first contact is connected to said second contact by an electrically conductive plate.

23. The light module of claim 20 in which said closure includes a cover plate, a pair of spaced side plates connected to said cover plate and a rod extending between said side plates.

24. The light module of claim 23 in which said pivot arm is pivotally mounted to said rod.

25. The light module of claim 24 further including a spring connected between said pivot arm and one of said side plates, said spring being effective to orient said pivot arm in a neutral position within said housing wherein said first and second nodes of said pivot arm do not engage either of said first and second contacts.

26. The light module of claim 20 in which one of said first and second nodes of said pivot arm is in continuous engagement with a respective one of said first and second contact except upon the application of motion or an inertial force.

* * * * *